United States Patent [19]

Kozacka et al.

[11] 4,021,765

[45] May 3, 1977

[54] ELECTRIC FUSE WITH PLATE-SUPPORTED FUSIBLE ELEMENT

[75] Inventors: Frederick J. Kozacka, South Hampton; Richard A. Belcher, Hampton Falls, both of N.H.

[73] Assignee: Gould Inc., Electric Fuse Division, Newburyport, Mass.

[22] Filed: Jan. 6, 1976

[21] Appl. No.: 646,896

[52] U.S. Cl. ..... 337/159; 337/295; 403/284

[51] Int. Cl.[2] ..... H01H 85/04; H01H 85/20

[58] Field of Search ..... 337/159, 161, 231, 234, 337/295; 339/220; 403/284, 186

[56] References Cited

UNITED STATES PATENTS

| | | | |
|---|---|---|---|
| 2,733,788 | 2/1956 | Farmer | 52/758 H |
| 3,797,194 | 3/1974 | Ekstein | 52/758 H |
| 3,846,728 | 11/1974 | Salzer | 337/231 |

*Primary Examiner*—William H. Beha, Jr.
*Attorney, Agent, or Firm*—Erwin Salzer

[57] ABSTRACT

An electric fuse has helically wound fusible element means which are supported by a mandrel made up of insulating plates. The latter engage grooves provided in terminal plugs of the fuse. The mandrel-forming plates are locked in position inside said grooves by cooperating abutment means. These abutment means are formed by recesses in the mandrel-forming plates, and by projections formed by displaced portions of the metal of which the plug terminals of the fuse are made, which portions enter into said recesses in said mandrel-forming plates and preclude relative movement of the latter and the plug terminals.

4 Claims, 7 Drawing Figures

ELECTRIC FUSE WITH PLATE-SUPPORTED FUSIBLE ELEMENT

BACKGROUND OF THE INVENTION

In fuses for elevated circuit voltages it is often necessary to use fusible element means whose length exceeds that of the casing, or fuse tube. In such instances the fusible element or elements are generally wound helically around a support of electric insulating material. Some such supports are made of a ceramic material and are substantially star-shaped in cross-section. Other such supports are made up of a plurality of elongated plate means of electric insulating material having radially outer longitudinal edges supporting the fusible element means, and having transverse edges engaging radially extending grooves provided in the axially inner end surfaces of plug terminals closing the ends of the casing, or fuse tube.

The dimensional stability of a fuse of the latter kind depends largely upon the strength of the means by which the supporting plates for the fusible element means are held in the plate receiving grooves of the plug terminals. Clamping of the portions of the fusible element supporting plates inside of plate-edge-receiving grooves of plug terminals is not satisfactory because even if the friction between the plates and the plate-receiving-grooves is initially large, and the structure initially dimensionally stable at room temperatures, the grip of the side walls of the grooves is drastically reduced and the dimensional stability of the structure impaired when the width of the grooves increases as the temperature of the plug terminals increases when the fuse is carrying current.

Another way of affixing the constituent plates of fusible element supports in grooves of plug terminals is by resorting to the use of adhesive bonds. Such bonds provide structures which have the required dimensional stability, but are relatively difficult to establish and may involve the use of adhesives which are dangerous to the health of unskilled labor.

Other relatively complex solutions to the above problem are found in U.S. Pat. Nos. 3,846,728 to E. Salzer, 12/05/74 for HIGH-VOLTAGE FUSE INCLUDING INSULATING MANDREL FOR SUPPORTING FUSIBLE ELEMENTS and in U.S. Pat. 3,851,289 to F. J. Kozacka, 12/26/74 for HIGH-VOLTAGE FUSE HAVING HELICALLY WOUND FUSIBLE ELEMENT AND SUPPORT FOR HELICALLY WOUND FUSIBLE ELEMENT.

It is the prime object of the invention to provide electric fuses of the above description not subject to the limitations of similar prior art devices.

SUMMARY OF THE INVENTION

The improvement characterizing the present invention consists in the provision of recesses in the lateral surfaces of the plate means which support the helically wound fusible element means, which recesses are arranged substantially at the levels of the axially inner end surfaces of the pair of plug terminals by which the casing is closed and in that portions of the metal of which said pair of plug terminals consist are displaced into said recesses and form abutments positively precluding any significant movement of said plate means relative to said pair of plug terminals.

DESCRIPTION OF PREFERRED EMBODIMENT

Figure 1:
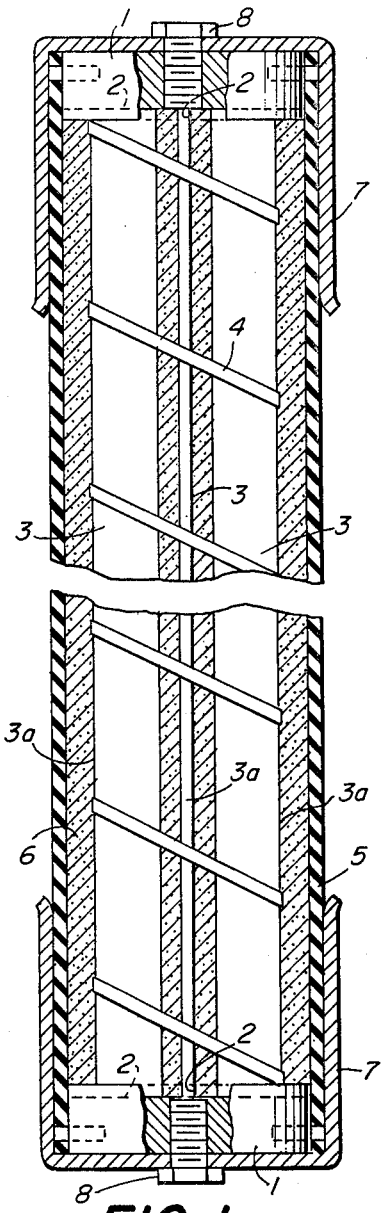
FIG. 1 is substantially a diagrammatic longitudinal section of a fuse embodying the present invention showing some parts in elevation rather than sectionalized.
Figure 2:
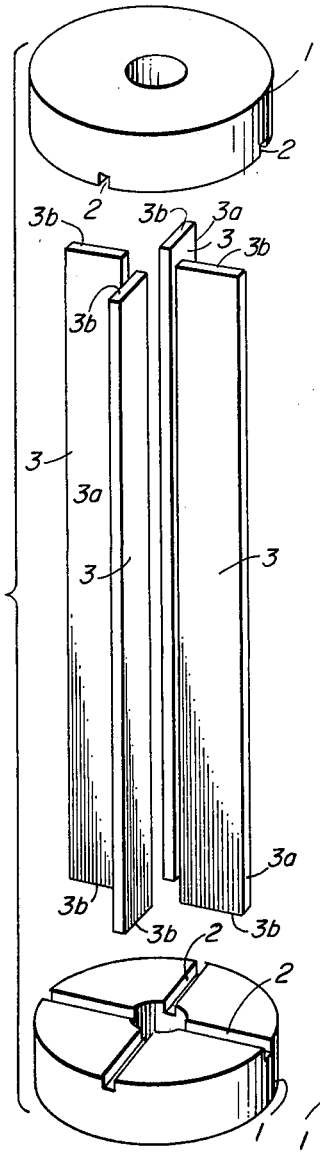
FIG. 2 is a diagrammatic exploded view of a structure for supporting helically wound fusible element means.

Referring now to the drawings, and more particularly to FIGS. 1 and 2 thereof, reference character 1 has been applied to indicate a pair of coaxially arranged plug terminals. The axially inner end surfaces of plug terminals 1 are provided with radially arranged grooves 2 that intersect at right angles in the centers of plug terminals 1. Reference character 3 has been applied to indicate four plates of electric insulating material having longitudinal edges *3a* supporting fusible element means 4. The latter are wound substantially helically around edges *3a* and interconnect conductively the pair of plug terminals 1. Plates 3 of electric insulating material have transverse edges *3b* which engage the grooves 2 in the axially inner end surfaces of plug terminals 1. Plug terminals 1 are press-fitted into a tubular casing 5 of electric insulating material which contains a granular arc-quenching filler 6. Fusible element means are submersed in filler 6. Ferrules 7 are mounted on the ends of casing 5 and screwed by screws 8 against the end surfaces of the pair of terminals 1. The passageway for insertion of one of screws 8 into one of plug terminals 1 may be used for filling grannular filler 6 into casing 5.

Figure 4:
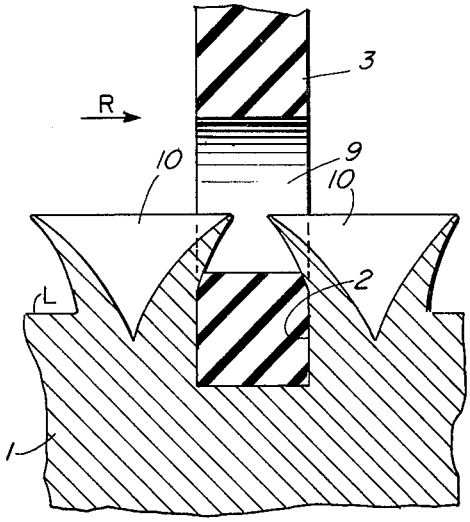
FIG. 4 is a section along V—IV of FIG. 3 and shows on a large scale how a support plate for fusible element means is affixed to one of a pair of plug terminals.
Figure 3:
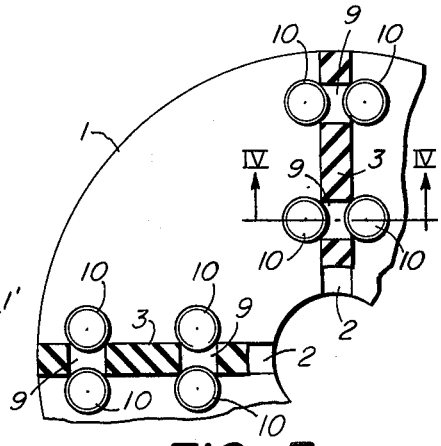
FIG. 3 is a transverse section along III—III of FIG. 5 of a portion of a fuse embodying the present invention.

FIG. 3 shows one sector of slightly more than 90° of a plug terminal having grooves 2 arranged at right angles. Grooves 2 are provided in the axially inner end surfaces of the pair of plug terminals 1 and the transverse edges *3b* of plates 3 project into grooves 2. The lateral surfaces of plates 3 are provided with recesses 9, e.g. cylindrical bores, which are arranged substantially at the levels of the axially inner end surfaces of the pair of plug terminals 1. In FIGS. 4, 5, 6 and 7 that level has been indicated by reference letter L. The lowest point of recess 9 shown in FIG. 4 is slightly above the level L of the axially inner end surface of plug terminal 1. Portions 10 of the metal of which plug terminals consist, e.g. brass, are displaced to project into recess or recesses 9 and form abutments positively precluding any, or any significant, movement of plate means 3 relative to the pair of plug terminals 1.

As indicated in FIG. 3 each plate 3 is provided with two recesses adjacent each transverse edge *3b* thereof. A portion 10 of the metal of which plug terminals 1 consist project into recesses 9. The projections 10 may be produced by a prick punch or any other tool appropriate for the purpose of displacing metal from the area of plug terminals 1 situated to opposite sides of plates 3 sideways into the space bounded by the planar lateral surfaces of plates 3. As shown in FIGS. 3 and 4 each plate 3 is clamped at each end thereof by four projections 10.

Figure 5:
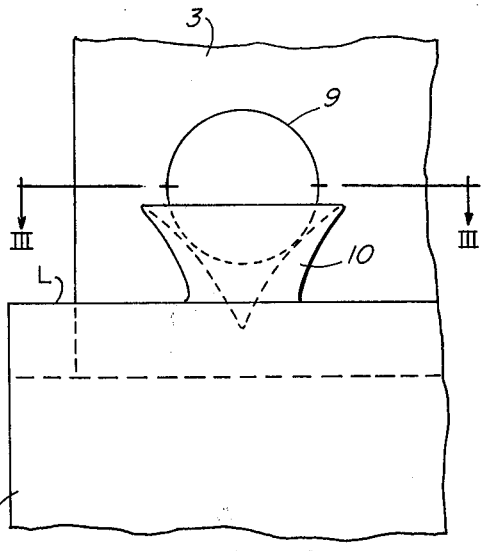
FIG. 5 is a side elevation of the structure of FIG. 4 seen in the direction of the arrow R of FIG. 4.
Figure 6:
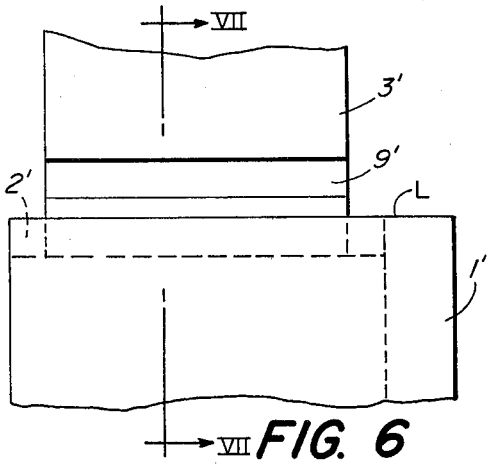
FIGS. 6 and 7 illustrate in a way similar to FIGS. 4 and 5 a modification of the structure shown in FIGS. 4 and 5.
Figure 7:
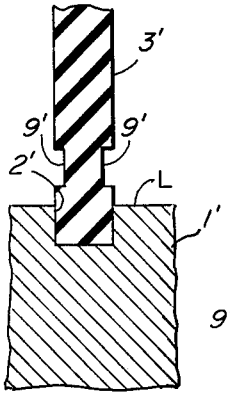

FIGS. 6 and 7 show a portion of a pair of terminal plugs 1' provided with a groove 2' into which a plate 3' of insulating material is inserted. In a full embodiment of the invention four such plates 3' are combined with a pair of plug terminals 1' as shown in FIGS. 1 and 2. As shown in FIGS. 6 and 7 the recesses 9 of FIGS. 3–5 are replaced by grooves 9' in the lateral surfaces of plates 3'. Grooves 9 are arranged substantially at the levels L of the axially inner end surfaces of plug terminals 1'. In FIGS. 6 and 7 the portions of metal of plugs 1' to be displaced into grooves 9 have not been shown. These portions of metal may have substantially the same configuration as the projections 10 shown in FIGS. 4 and 5.

We claim as our invention:

1. An electric fuse for elevated circuit voltages including a tubular casing of electric insulating material, a granular arcquenching filler inside said casing, substantially helically wound fusible element means submersed in said filler, a pair of plug terminals inserted into the ends of said casing and conductively interconnected by said fusible element means, elongated plate means of electric insulating material having longitudinal edges supporting said fusible element means and having transverse edges engaging grooves provided in the axially inner end surfaces of said pair of plug terminals wherein the improvement comprises recesses in the lateral surfaces of said plate means arranged substantially at the levels of said axially inner end surfaces of said pair of plug terminals, and portions of the metal of which said pair of plug terminals consist displaced to project into said recesses and forming abutments positively precluding any significant movement of said plate means relative to said pair of plug terminals.

2. An electric fuse as specified in claim 1 wherein said recesses are formed by bores projecting transversely through said plate means.

3. An electric fuse as specified in claim 1 wherein (a) said plate means are formed by four rectangular plates arranged at right angles; and (b) each of said plates is provided with a pair of transverse bores adjacent both ends thereof.

4. An electric fuse as specified in claim 1 wherein (a) said plate means are formed by rectangular plates arranged at right angles; and (b) each of said plates is provided at opposite sides thereof with a pair of grooves adjacent each of its ends.

* * * * *